US005755214A

United States Patent [19]

Lai

[11] Patent Number: 5,755,214

[45] Date of Patent: May 26, 1998

[54] VENTILATOR HOOD FOR A COOKER

[75] Inventor: Hung-chih Lai, Taichung Hsien, Taiwan

[73] Assignee: Ming-Jeong Lin, Taichung, Taiwan; a part interest

[21] Appl. No.: 747,395

[22] Filed: Nov. 12, 1996

[51] Int. Cl.[6] ..... F24C 15/20

[52] U.S. Cl. ..... 126/299 E; 126/299 D; 55/241; 55/DIG. 36

[58] Field of Search ..... 55/DIG. 36, 240, 55/241, 238; 126/299 E, 299 D

[56] References Cited

U.S. PATENT DOCUMENTS

| | | | |
|---|---|---|---|
| 4,071,019 | 1/1978 | King | 126/299 E |
| 4,351,652 | 9/1982 | Wisting | 55/240 |
| 4,390,206 | 6/1983 | Doane | 126/299 E |

*Primary Examiner*—Carl D. Price
*Attorney, Agent, or Firm*—Peterson, Wicks, Nemer & Kamrath, P.A.

[57] ABSTRACT

A ventilator hood includes a hood body having a first lengthwise wall, a second lengthwise wall, and a bottom wall. A bottom plate extends from a lower portion of the second lengthwise wall. A supporting plate extends upwardly from the bottom plate. An upright plate extends downwardly from the bottom wall, and an inlet opening is defined between the upright plate and the supporting plate. A spraying device includes an L-shaped plate having a vertical section extending downwardly from the bottom wall. A baffle extends upwardly from a horizontal section of the L-shaped plate and a space is defined between the L-shaped plate and the baffle. A passage is defined between the baffle and the upright plate. A wiper plate extends downwardly from a lower portion of the baffle and a channel is defined between the wiper plate and the supporting plate. A suction device includes an air guiding plate extending from a mediate portion of the second lengthwise wall and a vent defined between the air guiding plate and the wiper plate. A duct is defined between the second lengthwise plate and the vertical section of the L-shaped plate and a chamber is defined in the hood body and communicates with the duct.

6 Claims, 4 Drawing Sheets

VENTILATOR HOOD FOR A COOKER

FIELD OF THE INVENTION

The present invention relates to a ventilator hood adapted to be suitable for a cooker.

BACKGROUND OF THE INVENTION

A conventional ventilator hood for a cooker comprises a fan located above the cooker and actuated by a motor for evacuating an air/oil mixture released from the cooker to surroundings via a draining tube. By such an arrangement, however, air mixed with oil and smoke is directly drained to surroundings, thereby causing pollution to the environment.

The present invention has arisen to mitigate and/or obviate disadvantages of the conventional ventilator hood.

SUMMARY OF THE INVENTION

In accordance with one aspect of the present invention, there is provided a ventilator hood comprising a hood body including a first lengthwise wall, a second lengthwise wall, a top wall, a bottom wall, and two end portions. Two side plates are each fixedly mounted on each end portion of the hood body.

A bottom plate extends from a lower portion of the second lengthwise wall. A supporting plate extends upwardly from the bottom plate. An upright plate extends downwardly from the bottom wall. An inlet opening is defined between the upright plate and the supporting plate.

A spraying device includes an L-shaped plate having a vertical section extending downwardly from the bottom wall. A baffle extends upwardly from a horizontal section of the L-shaped plate and a space is defined between the L-shaped plate and the baffle. A passage is defined between the baffle and the upright plate.

A water supply tube is fixedly mounted between the two side plates and is disposed in the space. A plurality of nozzles are defined in the water supply tube.

A wiper plate extends downwardly from a lower portion of the baffle and a channel is defined between the wiper plate and the supporting plate.

A suction device includes an air guiding plate extending from a mediate portion of the second lengthwise wall. A suction vent is defined between the air guiding plate and the wiper plate. A duct is defined between the second lengthwise plate and the vertical section of the L-shaped plate. A chamber is defined in the hood body and communicates with the duct.

Further features of the present invention will become apparent from a careful reading of the detailed description with appropriate reference to the accompanying drawings.

DETAILED DESCRIPTION OF THE PREFERRED EMBODIMENTS

Figure 1:
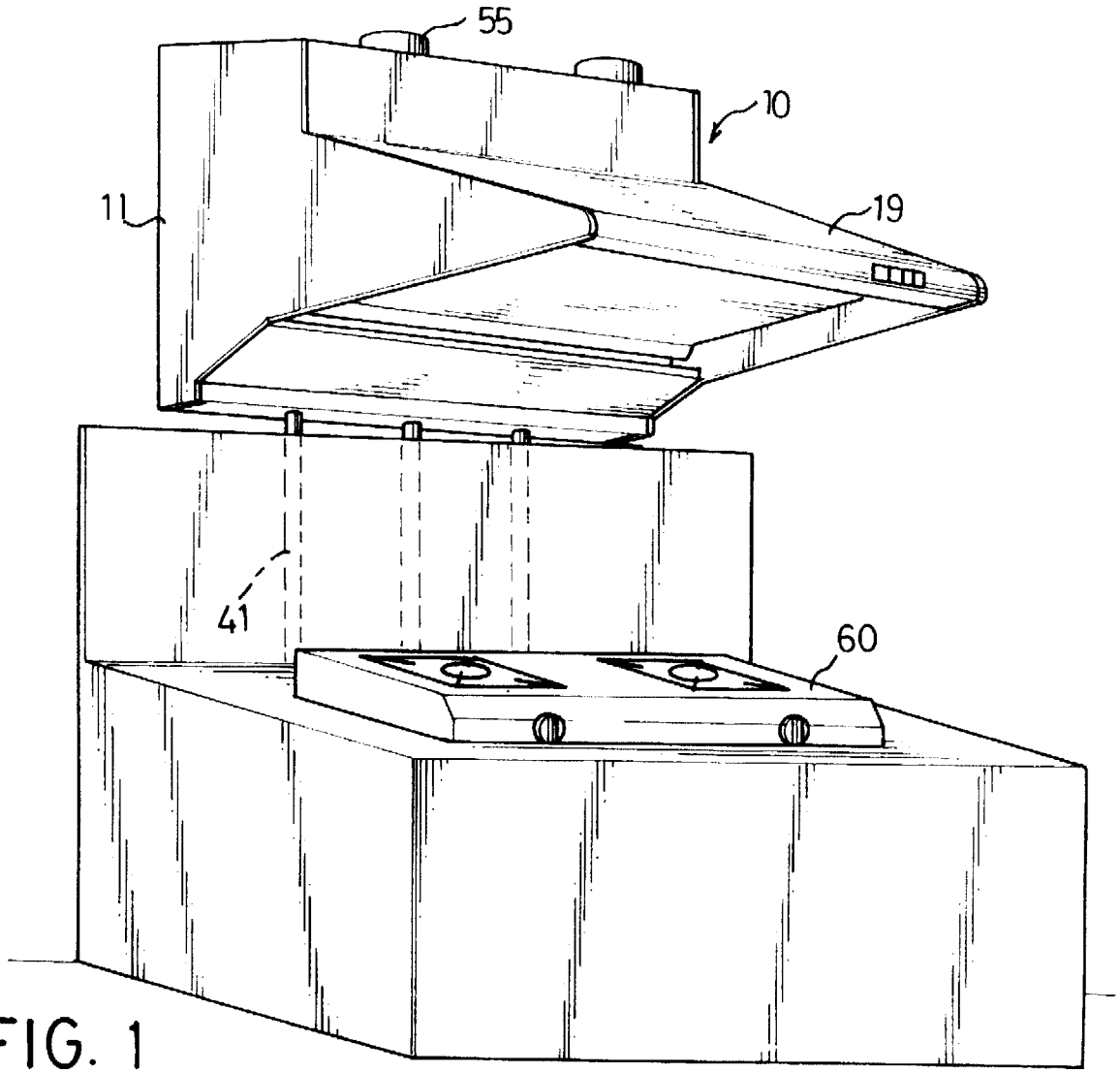
FIG. 1 is a perspective view of a ventilator hood for a cooker in accordance with the present invention.

Referring to the drawings and initially to FIGS. 1–4, a ventilator hood in accordance with the present invention is provided for drawing and draining an air/oil mixture created from a cooker 60 located thereunder and comprises a hood body (or housing) 10 including a first lengthwise wall 12 vertically arranged, a second lengthwise wall 14 vertically arranged, a top wall 13, a bottom wall 15, and two end portions. The second lengthwise wall 14 has a vertical length greater than that of the first lengthwise wall 12.

Two side plates 11 are each fixedly mounted on each of the two end portions of the hood body 10.

A bottom plate 16 transversely extends from a lower portion of the second lengthwise wall 14. A supporting plate 17 extends upwardly from the bottom plate 16. Preferably, the supporting plate 17 is arranged in an inclined manner and has a lower portion 170 vertically extending from the bottom plate 16 and an upper portion 172 extending upwardly.

An upright plate 18 extends downwardly from the bottom wall 15 and is located above the upper portion 172 of the supporting plate 17. A substantially V-shaped extension 19 has a first end portion extending from a lower portion of the upright plate 18 and a second end portion attached to a lower portion of the first lengthwise wall 12 of the hood body 10.

An inlet opening 20 is defined between the lower portion of the upright plate 18 and the upper portion 172 of the supporting plate 17.

A spraying device 30 is mounted on an underside of the bottom wall 15 of the hood body 10 and includes a substantially L-shaped plate 36 located adjacent to the second lengthwise wall 14 and having a vertical section extending downwardly from the bottom wall 15 and a horizontal section. A partition 320 is vertically mounted on the horizontal section of the L-shaped plate 36.

A baffle 32 extends upwardly from the horizontal section of the L-shaped plate 36 and is located adjacent to the upright plate 18. A space 300 is defined between the L-shaped plate 36 and the baffle 32. A passage 322 is defined between the baffle 32 and the upright plate 18 and communicates with the space 300 and the inlet opening 20.

A water supply tube 31 is fixedly mounted between the two side plates 11 and is disposed in the space 300. A plurality of nozzles 310 are defined in the water supply tube 31 and each communicate with the space 300.

An arcuate wiper plate 33 extends downwardly from a lower portion of the baffle 32 and is located above the supporting plate 17. A channel 332 is defined between the wiper plate 33 and the supporting plate 17 and communicates with the passage 322 and the inlet opening 20.

Figure 4:
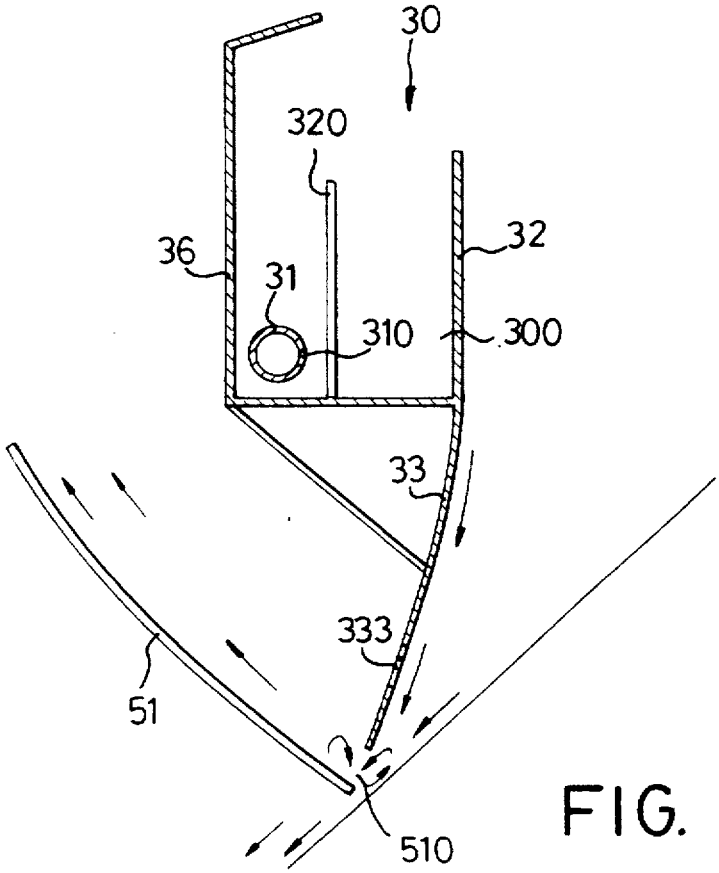
FIG. 4 is a side cross-sectional view showing a spraying device.
Figure 5:
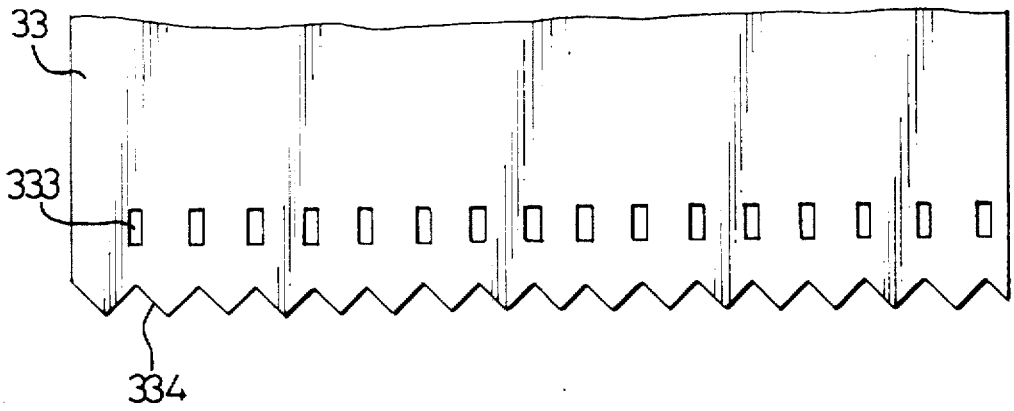
FIG. 5 is a partially cut-away front plan view of a wiper plate.

Referring to FIG. 4 and 5, the wiper plate 33 has a lower portion with a plurality of teeth 334 arranged thereon, and a plurality of slots 333 defined therein and located above the teeth 334.

A storage trough 40 is formed by the second lengthwise wall 14 of the hood body 10, the bottom plate 16 and the supporting plate 17. The storage trough 40 includes a plurality of draining tubes 41 vertically mounted therein and each extending outward of the bottom plate 16.

Figure 2:
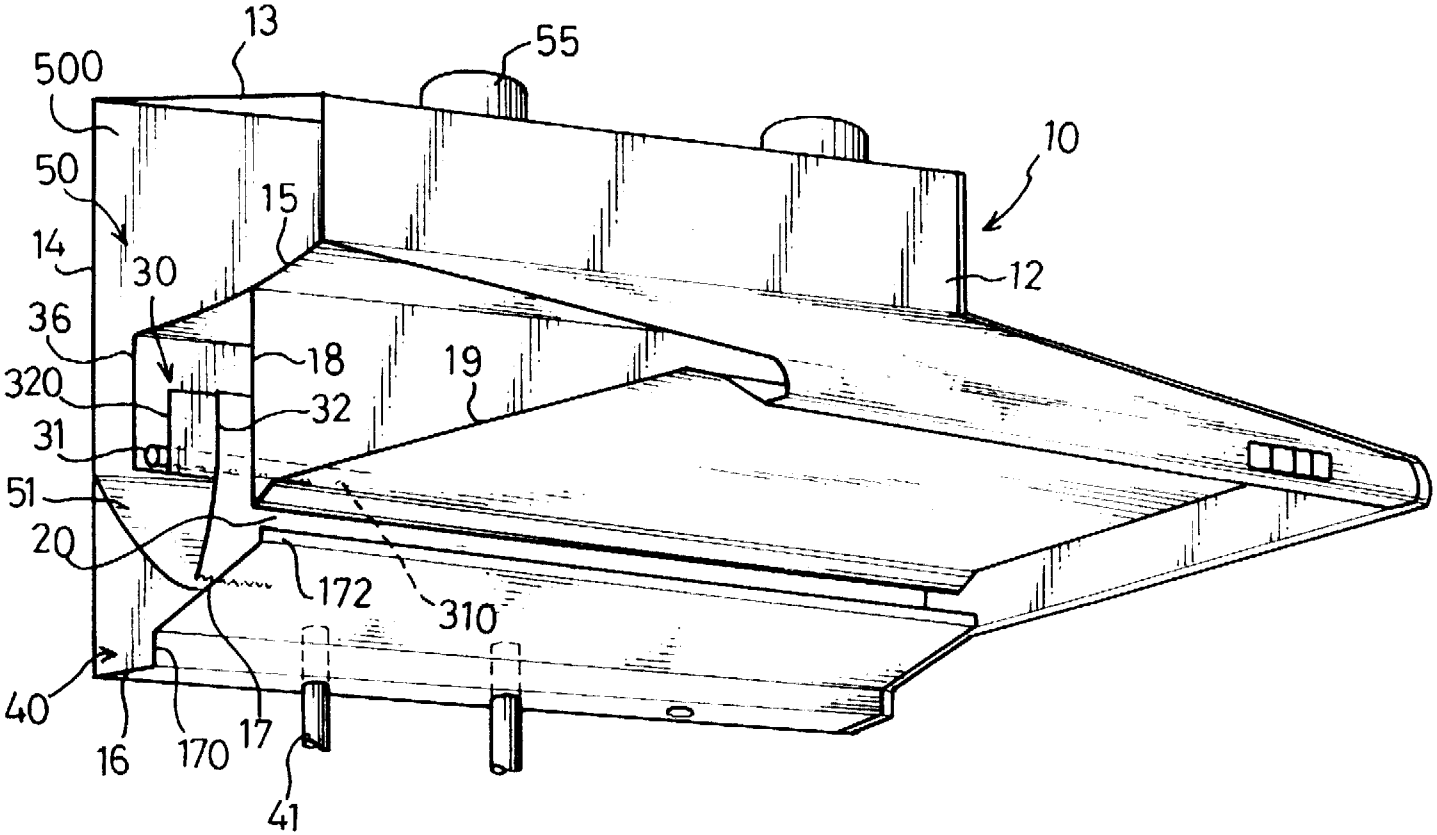
FIG. 2 is a partially cut-away perspective view of the ventilator hood.
Figure 3:
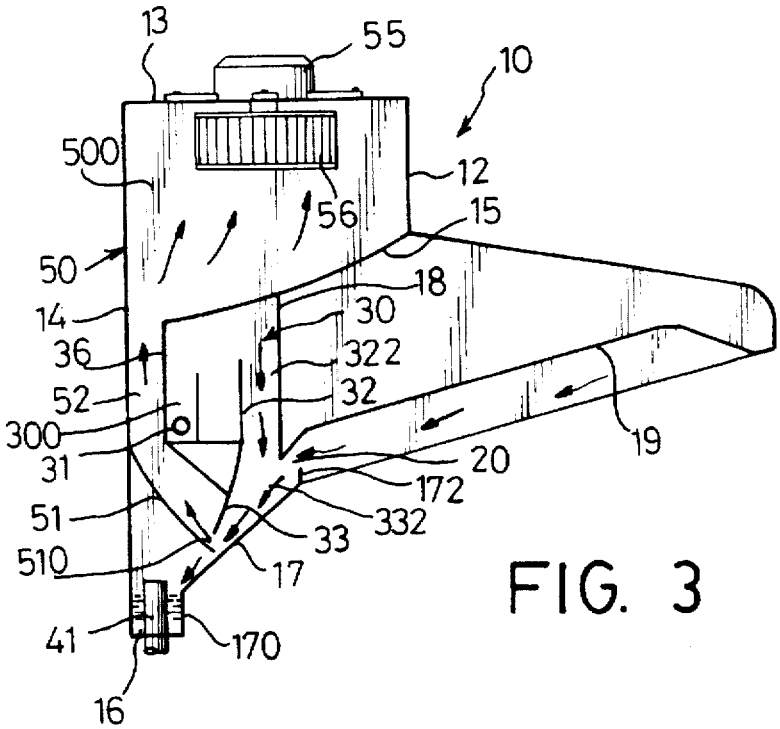
FIG. 3 is a side view of FIG. 2.

Referring to FIGS. 2 and 3, a suction device 50 is mounted in the hood body 10 and includes an air guiding plate 51 extending from a mediate portion of the second lengthwise wall 14 in an inclined manner and located adjacent to the supporting plate 17 and located under the wiper plate 33. A vent 510 is defined between the air guiding plate 51 and the wiper plate 33 and communicates with the channel 332.

A duct 52 is defined between the second lengthwise plate 14 and the vertical section of the L-shaped plate 36 and communicates with the vent 510. A chamber 500 is defined in the hood body 10 and communicates with the duct 52.

The suction device 50 further comprises a plurality of motors 55 mounted on the top wall 13 of the hood body 10, and a plurality of suction fans 56 mounted in the chamber 500 and each actuated by the motor 55.

In operation, referring to FIGS. 1–4, the air/oil mixture produced from the cooker 60 is introduced into the inlet opening 20 at a state of high temperature.

Then, each of the fans 56 is actuated by the motor 55 to draw air received in the chamber 500 and the duct 52 to surroundings, thereby forming a negative pressure status therein such that the air/oil mixture released from the cooker 60 can be accelerated to be drawn into the channel 332 through the inlet opening 20.

Water is then injected into the space 300 via the plurality of nozzles 310 of the water supply tube 31.

When the level of water is higher than that of the baffle 32, water will be introduced into the passage 322 and the channel 332 and is brought into contact with the air/oil mixture from the inlet opening 20 so as to condense the air/oil mixture at a high temperature, thereby separating the air from the oil.

The air released from the air/oil mixture can then be introduced into the duct 52 and the chamber 500 via the vent 510 by means of each of the fans 56 actuated by the associated motor 55, and finally drained to surroundings.

The air can also be introduced into the duct 52 through each of the holes 333 of the wiper plate 33.

The oil released from the air/oil mixture can then be taken away by the water to flow downwardly into the storage trough 40 through the channel 332.

It should be clear to those skilled in the art that further embodiments of the present invention may be made without departing from the scope and spirit of the present invention.

What is claimed is:

1. A ventilator hood comprising:

a hood body (10) including a first lengthwise wall (12) vertically arranged, a second lengthwise wall (14) vertically arranged, a top wall (13), a bottom wall (15), and two end portions, said second lengthwise wall (14) having a vertical length greater than that of said first lengthwise wall (12), two side plates (11) each fixedly mounted on each of the two end portions of said hood body (10), a bottom plate (16) transversely extending from a lower portion of said second lengthwise wall (14), a supporting plate (17) extending upwardly from said bottom plate (16), an upright plate (18) extending downwardly from said bottom wall (15) and located above said supporting plate (17);

an inlet opening (20) defined between a lower portion of said upright plate (18) and an upper portion of said supporting plate (17);

a spraying device (30) mounted on an underside of said bottom wall (18) of said hood body (10) and including:

a substantially L-shaped plate (36) located adjacent to said second lengthwise wall (14) and having a vertical section extending downwardly from said bottom wall (15) and a horizontal section;

a baffle (32) extending upwardly from the horizontal section of said L-shaped plate (36) and located adjacent to said upright plate (18), a space (300) defined between said L-shaped plate (36) and said baffle (32), a passage (322) defined between said baffle (32) and said upright plate (18) and communicating with said space (300) and said inlet opening (20);

a water supply tube (31) fixedly mounted between said two side plates (11) and disposed in said space (300), a plurality of nozzles (310) defined in said water supply tube (31) and each communicating with said space (300); and a wiper plate (33) extending downwardly from a lower portion of said baffle (32) and located above said supporting plate (17), a channel (332) defined between said wiper plate (33) and said supporting plate (17) and communicating with said passage (322) and said inlet opening (20); and a suction device (50) mounted in said hood body (10) and including:

an air guiding plate (51) extending from a mediate portion of said second lengthwise wall (14) and located adjacent to said supporting plate (17) and located under said wiper plate (33), a vent (510) defined between said air guiding plate (51) and said wiper plate (33) and communicating with said channel (332);

a duct (52) defined between said second lengthwise plate (14) and the vertical section of said L-shaped plate (36) and communicating with said vent (510); and a chamber (500) defined in said hood body (10) and communicating with said duct (52).

2. The ventilator hood in accordance with claim 1, wherein said suction device (50) further comprises at least one motor (55) mounted on said top wall (13) of said hood body (10), and at least one suction fan (56) mounted in said chamber (500) and actuated by said motor (55).

3. The ventilator hood in accordance with claim 1, wherein said wiper plate (33) has a lower portion with a plurality of teeth (334) arranged thereon, and a plurality of slots (333) defined therein and located above said teeth (334).

4. The ventilator hood in accordance with claim 1, wherein said spraying device (30) further comprises a partition (320) vertically mounted on the horizontal section of said L-shaped plate (36).

5. The ventilator hood in accordance with claim 1, further comprising a storage trough (40) formed by said second lengthwise wall (14) of said hood body (10), said bottom plate (16) and said supporting plate (17).

6. The ventilator hood in accordance with claim 5, wherein said storage trough (40) includes at least one draining tube (41) vertically mounted therein and extending outward of said bottom plate (16).

* * * * *